US009919191B2

(12) United States Patent
Inoue et al.

(10) Patent No.: US 9,919,191 B2
(45) Date of Patent: Mar. 20, 2018

(54) GOLF CLUB GRIP AND GOLF CLUB

(71) Applicant: DUNLOP SPORTS CO. LTD., Kobe-shi, Hyogo (JP)

(72) Inventors: Hidetaka Inoue, Kobe (JP); Kuniyasu Horiuchi, Kobe (JP); Toshiyuki Tarao, Kobe (JP); Kazuyoshi Shiga, Kobe (JP); Sho Goji, Kobe (JP); Chiemi Mikura, Kobe (JP); Hitoshi Oyama, Kobe (JP); Hiroshi Hasegawa, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 0 days.

(21) Appl. No.: 14/941,149

(22) Filed: Nov. 13, 2015

(65) Prior Publication Data

US 2016/0136491 A1 May 19, 2016

(30) Foreign Application Priority Data

Nov. 14, 2014 (JP) ..... 2014-231357

(51) Int. Cl.

| | |
|---|---|
| ***A63B 53/14*** | (2015.01) |
| *A63B 60/06* | (2015.01) |
| *A63B 60/14* | (2015.01) |
| *A63B 60/08* | (2015.01) |

(52) U.S. Cl.

CPC ..... *A63B 53/14* (2013.01); *A63B 60/06* (2015.10); *A63B 60/08* (2015.10); *A63B 60/14* (2015.10); *A63B 2209/00* (2013.01)

(58) Field of Classification Search

CPC ..... A63B 60/06; A63B 60/14; A63B 60/08; A63B 53/14

USPC ..... 473/300, 301, 302, 303

See application file for complete search history.

(56) References Cited

U.S. PATENT DOCUMENTS

| | | | | |
|---|---|---|---|---|
| 4,819,939 A * | 4/1989 | Kobayashi | ..... | A63B 53/14 473/299 |
| 5,322,290 A | 6/1994 | Minami | | |
| 5,634,859 A * | 6/1997 | Nesbitt | ..... | A63B 53/14 473/300 |
| 7,458,903 B2 * | 12/2008 | Wang | ..... | A63B 53/14 473/300 |

(Continued)

FOREIGN PATENT DOCUMENTS

| | | |
|---|---|---|
| JP | 60-61067 U | 4/1985 |
| JP | 62-82066 U | 5/1987 |

(Continued)

OTHER PUBLICATIONS

English translation of the Japanese Office Action for Japanese Application No. 2014-231357, dated Aug. 9, 2016.

*Primary Examiner* — Benjamin Layno

(74) *Attorney, Agent, or Firm* — Birch, Stewart, Kolasch & Birch, LLP

(57) ABSTRACT

An object of the present invention is to provide a golf club grip showing a good feeling both at hitting and at waggling. The present invention provides a golf club grip comprising a cylindrical portion for inserting a shaft, wherein the cylindrical portion has a compression strain in a range from 46% to 55% at a compression stress of 20 kg/cm$^2$, and a compression strain in a range from 63% to 69% at a compression stress of 120 kg/cm$^2$.

10 Claims, 4 Drawing Sheets

(56) References Cited

U.S. PATENT DOCUMENTS

| | | | | |
|---|---|---|---|---|
| 2013/0090183 | A1* | 4/2013 | Hachiro | A63B 53/14<br>473/300 |

FOREIGN PATENT DOCUMENTS

| | | | |
|---|---|---|---|
| JP | 4-95064 | U | 8/1992 |
| JP | 6-246022 | A | 9/1994 |
| JP | 11-347166 | A | 12/1999 |
| JP | 2010-94296 | A | 4/2010 |
| JP | 2010-154979 | A | 7/2010 |

* cited by examiner

GOLF CLUB GRIP AND GOLF CLUB

FIELD OF THE INVENTION

The present invention relates to a golf club grip.

DESCRIPTION OF THE RELATED ART

As a grip provided on a golf club, a grip made of rubber is widely utilized. As such a rubber grip, for example, Japanese Patent Publication No. H11-347166 A discloses a golf club grip composed of a surface layer formed from a solid rubber and an inner layer formed from a foamed rubber, wherein the golf club grip has a reduced weight by forming the inner layer from a foamed rubber obtained by adding and mixing a copolymer composed of vinylidene chloride and acrylonitrile and containing an organic solvent into an unvulcanized rubber formulation to obtain a material, and then vulcanization molding the material (refer to claim 2 of Japanese Patent Publication No. H11-347166 A).

SUMMARY OF THE INVENTION

It is crucial that a golf club grip is unlikely to slip at hitting and can be held firmly. For this reason, only performance of the golf club grip at hitting has been studied so far. However, many golfers conduct a behavior of moving a club head slightly from right to left, so-called waggling before hitting. This waggling is something like a small swing practice, and is effective for relaxing body and making a hitting image. Therefore, it is necessary for a golf club grip to show a good feeling not only at hitting but also at waggling. The present invention has been achieved in view of the above circumstances, and an object of the present invention is to provide a golf club grip showing a good feeling both at hitting and at waggling.

The present invention that can solve the above problems provides a golf club grip comprising a cylindrical portion for inserting a shaft, wherein the cylindrical portion has a compression strain in a range from 46% to 55% at a compression stress of 20 kg/cm$^2$, and a compression strain in a range from 63% to 69% at a compression stress of 120 kg/cm$^2$. If the cylindrical portion to be held by the user has the above compression properties, the cylindrical portion provides a good feeling both at hitting and at waggling.

The present invention also provide a golf club comprising a shaft, a head provided on one end of the shaft, and a grip provided on another end of the shaft, wherein the grip is the above-described golf club grip.

According to the present invention, a golf club grip providing a good feeling both at hitting and at waggling can be obtained.

DESCRIPTION OF THE PREFERRED EMBODIMENT

Figure 1:
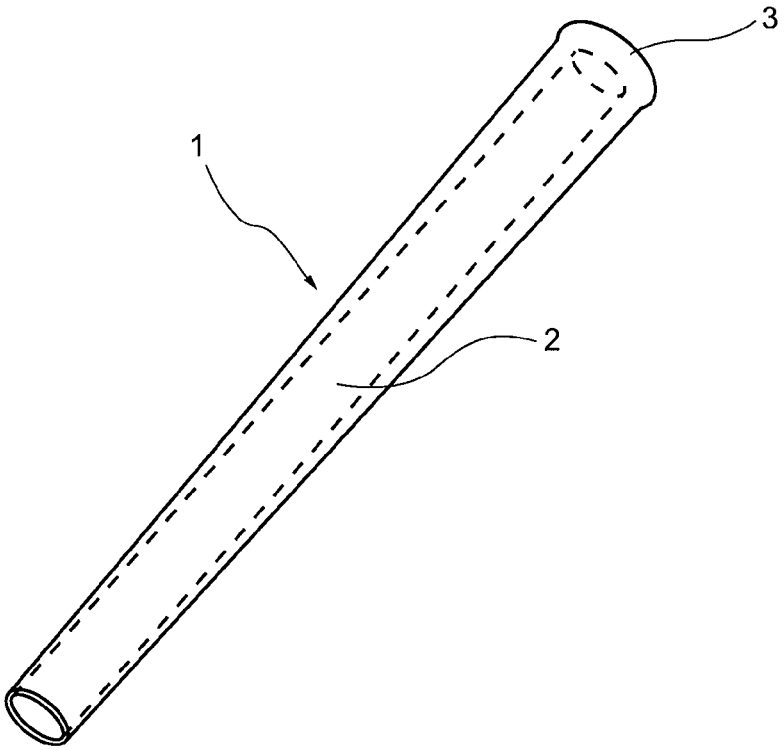
FIG. 1 is a perspective view showing one example of a golf club grip according to the present invention.

The present invention provides a golf club grip comprising a cylindrical portion for inserting a shaft, wherein the cylindrical portion has a compression strain in a range from 46% to 55% at a compression stress of 20 kg/cm$^2$, and a compression strain in a range from 63% to 69% at a compression stress of 120 kg/cm$^2$. If the cylindrical portion to be held by the user has the above compression properties, at the time of gripping firmly such as at hitting, the deformation larger than a specific amount is suppressed and thus the grip can be held firmly, and at the time of gripping lightly such as at waggling, the grip easily deforms and thus can provide a good feeling. Accordingly, a good feeling can be obtained both at hitting and at waggling. The compression properties of the cylindrical portion are measured according to the measurement methods described later. The compression properties of the cylindrical portion can be adjusted by a material constituting the cylindrical portion, a thickness of the cylindrical portion and the like.

The compression strain ($\epsilon 20$) of the cylindrical portion at the compression stress of 20 kg/cm$^2$ (1.96 MPa) is 46% or more, preferably 47% or more, more preferably 49% or more, and is 55% or less, preferably 54% or less, more preferably 53% or less. If the compression strain at the compression stress of 20 kg/cm$^2$ is 46% or more, feeling at waggling is soft and thus the cylindrical portion fits to the user's hand, and if the compression strain at the compression stress of 20 kg/cm$^2$ is 55% or less, feeling at waggling is not excessively soft, and thus the cylindrical portion does not give a feeling of unsteadiness to the user.

The compression strain ($\epsilon 120$) of the cylindrical portion at the compression stress of 120 kg/cm$^2$ (11.8 MPa) is 63% or more, preferably 65.5% or more, more preferably 66% or more, and is 69% or less, preferably 67.5% or less, more preferably 67% or less. If the compression strain at the compression stress of 120 kg/cm$^2$ is 63% or more, the grip deforms appropriately and the cylindrical portion lowers the impact at hitting, and thus a soft shot feeling can be obtained. If the compression strain at the compression stress of 120 kg/cm$^2$ is 69% or less, the grip does not excessively deform, and thus a stable shot feeling can be obtained.

In the cylindrical portion, a ratio ($\epsilon 120/\epsilon 20$) of the compression strain ($\epsilon 120$) at the compression stress of 120 kg/cm$^2$ to the compression strain ($\epsilon 20$) at the compression stress of 20 kg/cm$^2$ is preferably 1.20 or more, more preferably 1.25 or more, even more preferably 1.30 or more, and is preferably 1.45 or less, more preferably 1.43 or less, even more preferably 1.40 or less.

The thickness of the cylindrical portion is preferably 2.8 mm or more, more preferably 3.0 mm or more, even more preferably 3.2 mm or more, and is preferably 4.5 mm or less, more preferably 4.3 mm or less, even more preferably 4.1 mm or less. The cylindrical portion may be formed with a fixed thickness along the axis direction thereof, or may be formed with a thickness gradually becoming thicker from the front end toward the back end. It is noted that when the cylindrical portion has a non-uniform thickness, measurement values at a location having a distance of 50 mm from the grip end are adopted as the above compression properties.

The cylindrical portion of the golf club grip preferably comprises a cylindrical inner layer and a cylindrical outer layer covering the inner layer. If the cylindrical portion has a multiple-layered structure, the compression performance thereof can be easily controlled.

The thickness of the cylindrical outer layer is preferably 0.5 mm or more, more preferably 0.6 mm or more, even more preferably 0.7 mm or more, and is preferably 1.5 mm or less, more preferably 1.4 mm or less, even more preferably 1.3 mm or less. If the cylindrical outer layer has a thickness of 0.5 mm or more, the mechanical strength of the cylindrical outer layer increases, and the separation at the interface and the peeling off of the surface layer are suppressed. If the cylindrical outer layer has a thickness of 1.5 mm or less, the golfers are likely to be aware of characteristics of the cylindrical inner layer, and thus a good shot feeling can be provided.

The cylindrical inner layer and cylindrical outer layer may be a solid layer or a porous layer. The porous layer is a layer having a plurality of fines pores (voids) formed in rubber or resin which is a base material.

When the cylindrical inner layer is a porous layer, the density ($D_{in}$) of the cylindrical inner layer is preferably 0.25 g/cm$^3$ or more, more preferably 0.27 g/cm$^3$ or more, even more preferably 0.29 g/cm$^3$ or more, and is preferably 0.40 g/cm$^3$ or less, more preferably 0.38 g/cm$^3$ or less, even more preferably 0.36 g/cm$^3$ or less. If the cylindrical inner layer has a density of 0.25 g/cm$^3$ or more, the deformation amount of the cylindrical inner layer does not become excessively large, and thus a stable shot feeling can be obtained. If the cylindrical inner layer has a density of 0.40 g/cm$^3$ or less, this porous layer has a large effect on reducing a weight of the grip.

When the cylindrical outer layer is a porous layer, the density ($D_{out}$) of the cylindrical outer layer is preferably 0.6 g/cm$^3$ or more, more preferably 0.65 g/cm$^3$ or more, even more preferably 0.7 g/cm$^3$ or more, and is preferably 1.1 g/cm$^3$ or less, more preferably 1.05 g/cm$^3$ or less, even more preferably 1.0 g/cm$^3$ or less. If the cylindrical outer layer has a density of 0.6 g/cm$^3$ or more, the abrasion resistance of the cylindrical outer layer becomes better, and if the cylindrical outer layer has a density of 1.1 g/cm$^3$ or less, this porous layer has a large effect on reducing a weight of the grip.

When both the cylindrical inner layer and the cylindrical outer layer are porous layers, a density ratio ($D_{out}/D_{in}$) of the density ($D_{out}$) of the cylindrical outer layer to the density ($D_{in}$) of the cylindrical inner layer is preferably 1.6 or more, more preferably 1.8 or more, even more preferably 2.0 or more, and is preferably 4.5 or less, more preferably 4.3 or less, even more preferably 4.0 or less.

The material of the golf club grip according to the present invention is not particularly limited. The golf club grip can be formed from a rubber composition or a resin composition, and is preferably formed from the rubber composition.

The rubber composition preferably contains a base rubber and a crosslinking agent. Examples of the base rubber include a natural rubber (NR), ethylene-propylene-diene rubber (EPDM), butyl rubber (IIR), acrylonitrile-butadiene rubber (NBR), hydrogenated acrylonitrile-butadiene rubber (HNBR), carboxyl-modified acrylonitrile-butadiene rubber (XNBR), butadiene rubber (BR), styrene-butadiene rubber (SBR), polyurethane rubber (PU), isoprene rubber (IR), chloroprene rubber (CR), and ethylene-propylene rubber (EPM). Among them, NR, EPDM, IIR, NBR, HNBR, XNBR, BR, SBR, and PU are preferred as the base rubber.

As the crosslinking agent, a sulfur crosslinking agent and an organic peroxide can be used. Examples of the sulfur crosslinking agent include an elemental sulfur and a sulfur donor type compound. Examples of the elemental sulfur include powdery sulfur, precipitated sulfur, colloidal sulfur, and insoluble sulfur. Examples of the sulfur donor type compound include 4,4'-dithiobismorpholine. Examples of the organic peroxide include dicumyl peroxide, α,α'-bis(t-butylperoxy-m-diisopropyl)benzene, 2,5-dimethyl-2,5-di(t-butylperoxy)hexane, and 1,1-bis(t-butylperoxy)-3,3,5-trimethylcyclohexane. The crosslinking agent may be used solely, or two or more of them may be used in combination. As the crosslinking agent, the sulfur crosslinking agent is preferred, and the elemental sulfur is more preferred. The amount of the crosslinking agent is preferably 0.2 part by mass or more, more preferably 0.4 part by mass or more, even more preferably 0.6 part by mass or more, and is preferably 4.0 parts by mass or less, more preferably 3.5 parts by mass or less, even more preferably 3.0 parts by mass or less, with respect to 100 parts by mass of the base rubber.

The rubber composition preferably further contains a vulcanization accelerator and a vulcanization activator.

Examples of the vulcanization accelerator include thiurams such as tetramethylthiuram disulfide (TMTD), tetramethylthiuram monosulfide (TMTM) and dipentamethylenethiuram tetrasulfide; guanidines such as diphenylguanidine (DPG); dithiocarbamates such as zinc dimethyldithiocarbamate (ZnPDC) and zinc dibutyldithiocarbamate; thioureas such as trimethylthiourea and N,N'-diethylthiourea; thiazoles such as mercaptobenzothiazole (MBT) and benzothiazole disulfide; sulfenamides such as N-cyclohexyl-2-benzothiazolylsulfenamide (CBS) and N-t-butyl-2-benzothiazolylsulfenamide (BBS); and the like. These vulcanization accelerators may be used solely, or two or more of them may be used in combination. The amount of the vulcanization accelerator is preferably 0.4 part by mass or more, more preferably 0.8 part by mass or more, even more preferably 1.2 parts by mass or more, and is preferably 8.0 parts by mass or less, more preferably 7.0 parts by mass or less, even more preferably 6.0 parts by mass or less, with respect to 100 parts by mass of the base rubber.

Examples of the vulcanization activator include a metal oxide, a metal peroxide, and a fatty acid. Examples of the metal oxide include zinc oxide, magnesium oxide, and lead oxide. Examples of the metal peroxide include zinc peroxide, chromium peroxide, magnesium peroxide, and calcium peroxide. Examples of the fatty acid include stearic acid, oleic acid, and palmitic acid. These vulcanization activators may be used solely, or two or more of them may be used in combination. The amount of the vulcanization activator is preferably 0.5 part by mass or more, more preferably 0.6 part by mass or more, even more preferably 0.7 part by mass or more, and is preferably 10.0 parts by mass or less, more preferably 9.5 parts by mass or less, even more preferably 9.0 parts by mass or less, with respect to 100 parts by mass of the base rubber.

The rubber composition may further contain a reinforcing material, antioxidant, softening agent, vulcanization retardant, coloring agent, and the like where necessary.

Examples of the reinforcing material include carbon black and silica. The amount of the reinforcing material is preferably 2.0 parts by mass or more, more preferably 3.0 parts by mass or more, even more preferably 4.0 parts by mass or more, and is preferably 50 parts by mass or less, more preferably 45 parts by mass or less, even more preferably 40 parts by mass or less, with respect to 100 parts by mass of the base rubber.

Examples of the antioxidant include imidazoles, amines and phenols. Examples of the imidazoles include nickel dibutyldithiocarbamate (NDIBC), 2-mercaptobenzimidazole, and zinc salt of 2-mercaptobenzimidazole. Examples of the amines include phenyl-α-napthylamine. Examples of the phenols include 2,2'-methylene bis(4-methyl-6-t-butylphenol) (MBMBP), and 2,6-di-tert-butyl-4-methylphenol. These antioxidants may be used solely, or two or more of them may be used in combination. The amount of the antioxidant is preferably 0.2 part by mass or more, more preferably 0.3 part by mass or more, even more preferably 0.4 part by mass or more, and is preferably 5.0 parts by mass or less, more preferably 4.8 parts by mass or less, even more preferably 4.6 parts by mass or less, with respect to 100 parts by mass of the base rubber.

Examples of the softening agent include a mineral oil and a plasticizer. Examples of the mineral oil include paraffin oil, naphthene oil, aromatic oil, and process oil. Examples of the plasticizer include dioctyl phthalate, dibutyl phthalate, dioctyl sebacate, and dioctyl adipate.

The rubber composition can be prepared by a conventionally known method, for example, by kneading raw materials using a kneading machine such as Banbury mixer, a kneader, and an open roll. The temperature (material temperature) during kneading preferably ranges from 90° C. to 160° C. In addition, when the composition contains microballoons described later, kneading is preferably performed at a temperature lower than the expansion starting temperature of the microballoons.

The material hardness $H_{in}$ (JIS-A) of the cylindrical inner layer is preferably 40 or more, more preferably 42 or more, even more preferably 44 or more, and is preferably 65 or less, more preferably 62 or less, even more preferably 59 or less. If the cylindrical inner layer has a material hardness $H_{in}$ (JIS-A) of 40 or more, the deformation amount of the cylindrical inner layer does not become excessively large at hitting, and thus a stable shot feeling can be obtained. If the cylindrical inner layer has a material hardness $H_{in}$ (JIS-A) of 65 or less, the cylindrical inner layer deforms appropriately at hitting, lowers the impact at hitting, and thus provides a better shot feeling. The material hardness can be adjusted by the type or formulation of the base rubber or base resin.

The material hardness $H_{out}$ (JIS-A) of the cylindrical outer layer is preferably 40 or more, more preferably 42 or more, even more preferably 44 or more, and is preferably 65 or less, more preferably 62 or less, even more preferably 59 or less. If the cylindrical outer layer has a material hardness $H_{out}$ (JIS-A) of 40 or more, the deformation amount of the cylindrical outer layer does not become excessively large at waggling, and thus has little effect on swing. If the cylindrical outer layer has a material hardness $H_{out}$ (JIS-A) of 65 or less, the cylindrical outer layer deforms appropriately at waggling, and thus provides a feeling of fitting to the user's hand.

When the cylindrical portion comprises the cylindrical inner layer and the cylindrical outer layer, the material hardness $H_{in}$ (JIS-A) of the cylindrical inner layer and the material hardness $H_{out}$ (JIS-A) of the cylindrical outer layer may be identical or different. Combining a high hardness layer and a lower hardness layer allows to control properties of the grip to a higher extent.

If the material hardness $H_{in}$ (JIS-A) of the cylindrical inner layer is higher than the material hardness $H_{out}$ (JIS-A) of the cylindrical outer layer, the golfers are aware of the material hardness of the cylindrical inner layer when the grip deforms largely at hitting, and thus a stable shot feeling can be obtained. In this case, the hardness difference ($H_{in}-H_{out}$) between them is preferably more than 0, more preferably 2 or more, even more preferably 4 or more, and is preferably 25 or less, more preferably 23 or less, even more preferably 21 or less.

By making the material hardness $H_{out}$ (JIS-A) of the outer layer higher than the material hardness $H_{in}$ (JIS-A) of the inner layer, the impact at hitting can be lowered while feeling at waggling is kept relatively hard. Further, by making the material hardness of the outer layer higher than the material hardness of the inner layer, the abrasion resistance of the grip can be enhanced. In this case, the hardness difference ($H_{out}-H_{in}$) between them is preferably more than 0, more preferably 2 or more, even more preferably 4 or more, and is preferably 25 or less, more preferably 23 or less, even more preferably 21 or less.

The golf club grip can be obtained by molding the rubber composition in a mold. Examples of the molding method include press molding and injection molding. The golf club grip comprising the inner layer and the outer layer can be obtained, for example, by press molding a laminated product comprising an unvulcanized rubber sheet formed from the outer layer rubber composition and an unvulcanized rubber sheet formed from the inner layer rubber composition in a mold. When press molding is adopted, the temperature of the mold preferably ranges from 140° C. to 200° C., the molding time preferably ranges from 5 minutes to 40 minutes, and the molding pressure preferably ranges from 0.1 MPa to 100 MPa.

Examples of the method producing the porous layer include a balloon foaming method, chemical foaming method, supercritical carbon dioxide injection molding method, salt extraction method, and solvent removing method. In the balloon foaming method, microballoons are allowed to be contained in the rubber composition, and then be expanded by heating to perform foaming. Alternatively, the expanded microballoons may be blended in the rubber composition, and then the resultant rubber composition is molded. In the chemical foaming method, a foaming agent (such as azodicarbonamide, azobisisobutyronitrile, N,N'-dinitrosopentamethylenetetramine, p-toluenesulfonyl hydrazine, and p-oxybis(benzenesulfonohydrazide)) and a foaming auxiliary are allowed to be contained in the rubber composition, and then a gas (such as carbon dioxide gas and nitrogen gas) is produced by a chemical reaction to perform foaming. In the supercritical carbon dioxide injection molding method, the rubber composition is immersed in carbon dioxide being in a supercritical state at a high pressure, the resultant rubber composition is injected at a normal pressure, and carbon dioxide is gasified to perform foaming. In the salt extraction method, a soluble salt (such as boric acid and calcium chloride) is allowed to be contained in the rubber composition, and then the salt is dissolved and extracted after molding to form fine pores. In the solvent removing method, a solvent is allowed to be contained in the rubber composition, and then the solvent is removed after molding to form fine pores.

When the cylindrical inner layer or cylindrical outer layer is the porous layer, a foamed layer formed by the balloon foaming method is preferred. In other words, the porous layer is preferably a foamed layer formed from a rubber composition including microballoons. If microballoons are used, the porous layer has a light weight while maintaining the mechanical strength thereof. As the microballoons, organic microballoons or inorganic microballoons may be used. Examples of the organic microballoons include hollow particles formed from a thermoplastic resin, and resin capsules encapsulating a hydrocarbon having a low boiling point in a shell formed from a thermoplastic resin. Specific examples of the resin capsules include Expancel (registered trademark) manufactured by Akzo Nobel Company, and Matsumoto Microsphere (registered trademark) manufactured by Matsumoto Yushi Seiyaku Co., Ltd. Examples of the inorganic microballoons include hollow glass particles (such as silica balloons and alumina balloons), and hollow ceramic particles.

When the porous layer is formed by the balloon foaming method, the amount of microballoons in the rubber composition is preferably 7 parts by mass or more, more preferably 8 parts by mass or more, even more preferably 9 parts by mass or more, and is preferably 18 parts by mass or less, more preferably 17 parts by mass or less, even more preferably 16 parts by mass or less, with respect to 100 parts by mass of the base rubber. If the amount of microballoons is 7 parts by mass or more, foaming can be performed sufficiently to provide a reduced weight. If the amount of microballoons is 18 parts by mass or less, the resultant layer shows high mechanical strength and good hitting impact resistance.

The shape of the golf club grip according to the present invention is not particularly limited, and a conventionally known shape can be adopted. Examples of the grip shape include a shape comprising a cylindrical portion for inserting a shaft and an integrally molded cap portion for covering the opening of the back end of the cylindrical portion.

The cylindrical portion preferably comprises a cylindrical inner layer and a cylindrical outer layer covering the inner layer. Examples of the combination of the cylindrical inner layer and cylindrical outer layer include a combination of a solid inner layer and a solid outer layer; a combination of a porous inner layer and a porous outer layer; a combination of a porous inner layer and a solid outer layer; and a combination of a solid inner layer and a porous outer layer. In addition, the cylindrical portion may further comprises an adhesive layer between the cylindrical inner layer and the cylindrical outer layer. Examples of the adhesive constituting the adhesive layer include a crosslinking adhesive. The adhesive layer enhances the peeling strength between the inner layer and the outer layer.

The cylindrical portion may be formed with a fixed thickness along the axis direction thereof, or may be formed with a thickness gradually becoming thicker from the front end toward the back end. In addition, the cylindrical portion may be formed with a fixed thickness along the diameter direction thereof, or a projecting strip part (so-called back line) may be formed on a part of the cylindrical portion. Furthermore, a groove may be formed on the surface of the cylindrical portion. Formation of a water film between the hand of the golfer and the grip may be suppressed by the groove, and thus grip performance in a wet condition is further enhanced. In addition, in view of anti-slip performance and abrasion resistance of the grip, a reinforcing cord may be disposed in the grip.

The golf club according to the present invention comprises a shaft, a head provided on one end of the shaft, and a grip provided on another end of the shaft, wherein the grip is formed from the above-described rubber composition. The shaft can be made of stainless steel or a carbon fiber reinforcing resin. Examples of the head include a wood type, utility type, and iron type. The material constituting the head is not particularly limited, and examples thereof include titanium, a titanium alloy, a carbon fiber reinforcing plastic, stainless steel, maraging steel, and soft iron.

Next, the golf club grip and golf club according to the present invention will be explained with reference to figures. FIG. 1 is a perspective view showing one example of a golf club grip according to the present invention. A grip 1 comprises a cylindrical portion 2 for inserting a shaft therein, and an integrally molded cap portion 3 for covering the opening of the back end of the cylindrical portion.

Figure 2:
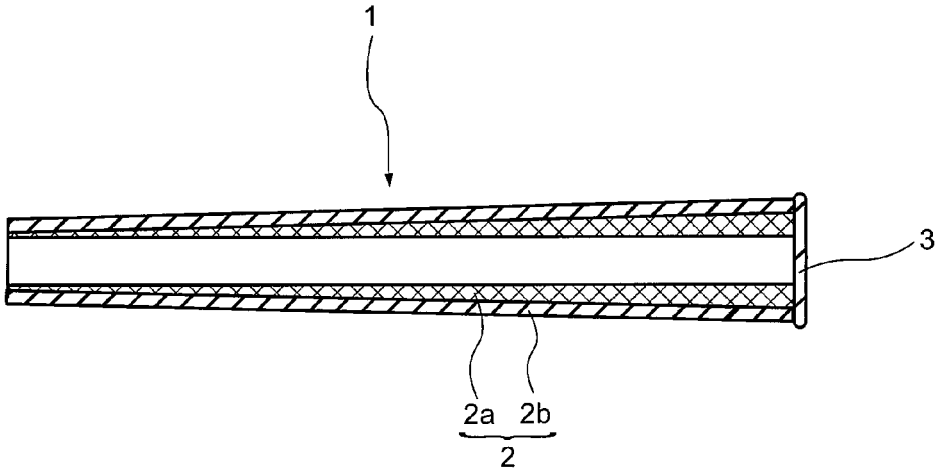
FIG. 2 is a schematic cross-sectional view showing one example of a golf club grip according to the present invention.

FIG. 2 is a schematic cross-sectional view showing one example of a golf club grip according to the present invention. The cylindrical portion 2 is composed of an inner layer 2*a* and an outer layer 2*b* along the entire longitudinal direction thereof. The outer layer 2*b* is formed with a uniform thickness throughout the entire region from the front end to the back end. The inner layer 2*a* is formed with a thickness gradually becoming thicker from the front end toward the back end. In the grip 1 shown in FIG. 2, the inner layer 2*a* is a porous layer, the outer layer 2*b* is a solid layer, and the cap portion 3 is formed from the same rubber composition as the outer layer 2*b*.

Figure 3:
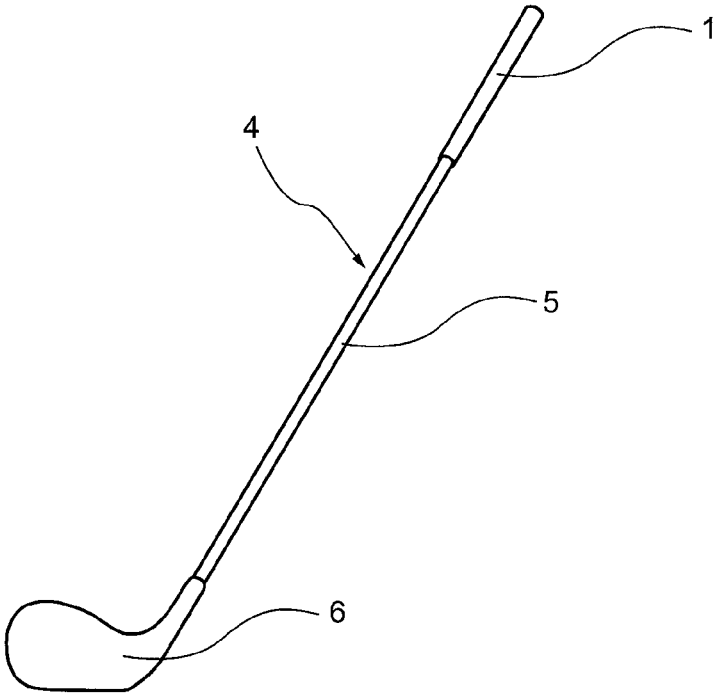
FIG. 3 is a perspective view showing one example of a golf club according to the present invention.

FIG. 3 is a perspective view showing one example of the golf club according to the present invention. A golf club 4 comprises a shaft 5, a head 6 provided on one end of the shaft 5, and a grip 1 provided on another end of the shaft 5. The back end of the shaft 5 is inserted into the cylindrical portion 2 of the grip 1.

EXAMPLES

Hereinafter, the present invention will be described in detail by way of examples. However, the present invention is not limited to the examples described below, and various changes and modifications can be made without departing from the spirit of the present invention and are included in the technical scope of the present invention.

[Evaluation Method]

(1) Material Hardness (JIS-A)

Sheets with a thickness of 2 mm were produced by pressing the rubber composition at 160° C. for 15 minutes. It is noted that, in the case that the rubber composition includes microballoons, the sheets were produced without expanding microballoons. These sheets were stored at 23° C. for two weeks. Three of these sheets were stacked on one another, and the stack was measured with an auto loading durometer (manufactured by Kobunshi Keiki Co., Ltd., type P1, provided with a type A durometer prescribed in JIS K6253-3 (2012)).

(2) Density

A layer which was a measurement object was cut off from the grip, and measured with an auto gravimeter (SP-GR1 manufactured by MS-TEC Co. Ltd., based on Archimedes' principle). A weight in water and a weight in air at 23° C. were measured, and the density was calculated from these measurement values.

(3) Compression Strain

A test piece (20 mm×20 mm) was cut off from the golf club grip. It is noted that the test piece was cut so that the portion at a distance of 50 mm in the axis direction from the grip end (back end of the cap portion) becomes the center of the test piece. Compression properties of the test piece were measured with a table-top type precision universal tester (Autograph AGS-5kNG manufactured by Shimadzu Corporation). The measurement was performed under the conditions of an initial load of 40N, compression speed of 3 mm/min and measurement temperature of 23° C., without applying a lubricating oil on the compression plate. At the state of loading the initial load, the stress was set as 0 kg/cm$^2$ and the displacement was set as 0 mm.

(4) Feeling

The grip was set on a shaft to produce a golf club. The golf club was used by ten golfers and feeling thereof was evaluated by the ten golfers. Feeling at waggling, feeling at hitting and overall evaluation was evaluated according to the following three-grade evaluation standard.

G (Good): at least eight golfers answered that feeling was good.

F (Fair): five to seven golfers answered that feeling was good.

P (Poor): at most four golfers answered that feeling was good.

[Production of Grip]

Raw materials having the formulations shown in Table 1 were mixed and kneaded with Banbury mixer (material temperature: 80° C. to 150° C.) to prepare the rubber compositions.

TABLE 1

| Rubber composition No. | | A | A1 | B | B1 | B2 | B3 | B4 | B5 | C | C1 | D | D1 |
|---|---|---|---|---|---|---|---|---|---|---|---|---|---|
| Formulation (parts by mass) | Natural rubber | 70 | | | | 70 | | | | 70 | | 70 | |
| | EPDM | 30 | | | | 30 | | | | 30 | | 30 | |
| | Carbon black | 1.0 | | | | 4.0 | | | | 20.0 | | 55.0 | |
| | Silica | 2.0 | | | | 8.0 | | | | 8.0 | | 8.0 | |
| | Sulfur | 2.0 | | | | 2.0 | | | | 2.0 | | 2.0 | |
| | Zinc oxide | 3.0 | | | | 3.0 | | | | 3.0 | | 3.0 | |
| | Stearic acid | 1.0 | | | | 1.0 | | | | 1.0 | | 1.0 | |
| | Process oil | 2.0 | | | | 2.0 | | | | 2.0 | | 2.0 | |
| | Vulcanization activator | 3.0 | | | | 3.0 | | | | 3.0 | | 3.0 | |
| | Foaming agent | — | 12.0 | — | 2.0 | 6.0 | 12.0 | 16.0 | 20.0 | — | 12.0 | — | 12.0 |
| Material hardness (JIS-A) | | 44 | 45 | 51 | 51 | 51 | 52 | 53 | 54 | 57 | 58 | 67 | 68 |

Materials used in Table 1 are shown below.

Natural rubber: TSR 20

EPDM: ESPRENE (registered trademark) 505 A (ethylene-propylene-diene rubber) manufactured by Sumitomo Chemical Co., Ltd.

Carbon black: SEAST SO (FEF) manufactured by Tokai Carbon Co., Ltd.

Silica: ULTRASIL VN3 manufactured by EVONIK Industries

Sulfur: 5% oil treated sulfur fine powder (200 mesh) manufactured by Tsurumi Chemical Industry Co., Ltd.

Zinc oxide: Ginrei R manufactured by Toho Zinc Co., Ltd.

Stearic acid: beads stearic acid camellia manufactured by NOF Co., Ltd.

Process Oil: Diana Process Oil PA32 manufactured by Idemitsu Kosan Co., Ltd.

Vulcanization activator: a mixture of SOXINOL D, NOCCELER (registered trademark) CZ and NOCCELER NS in a mixing ratio (mass ratio) of 1:1:1

NOCCELER CZ: N-cyclohexyl-2-benzothiazolylsulfenamide manufactured by Ouchi Shinko Chemical Industry Co., Ltd.

NOCCELER NS: N-t-butyl-2-benzothiazolylsulfenamide manufactured by Ouchi Shinko Chemical Industry Co., Ltd.

SOXINOL D: 1,3-diphenylguanidine manufactured by Sumitomo Chemical Co., Ltd.

Figure 4:
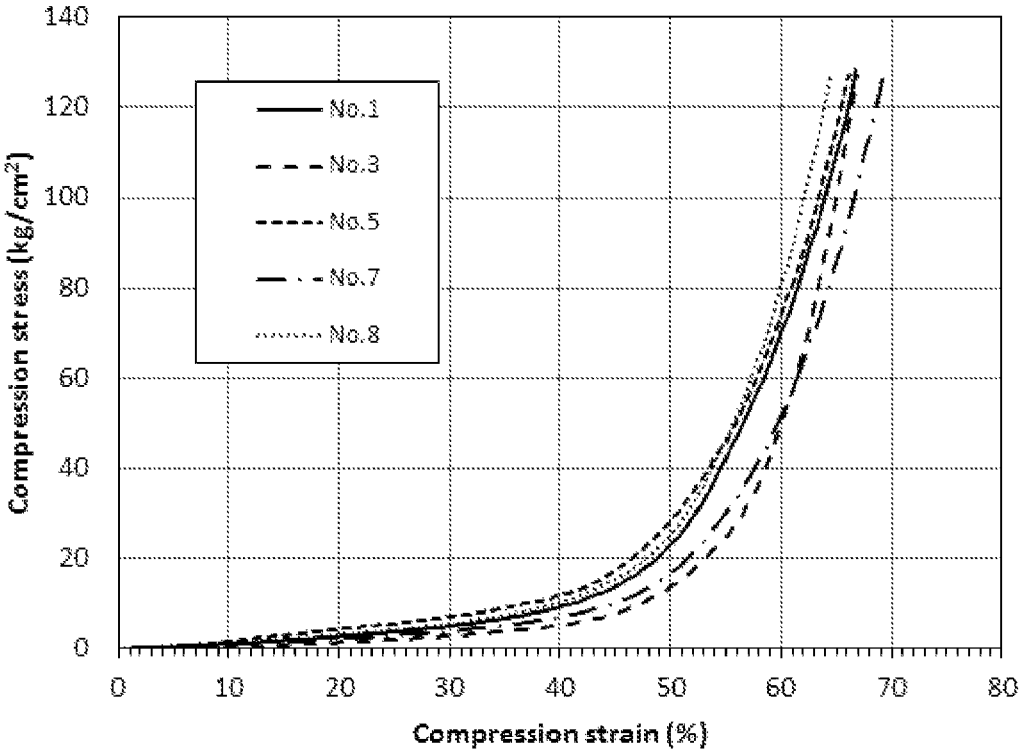
FIG. 4 is a graph showing a relationship between a compression stress and a compression strain of Grips No. 1, No. 3, No. 5, No. 7 and No. 8.
Figure 5:
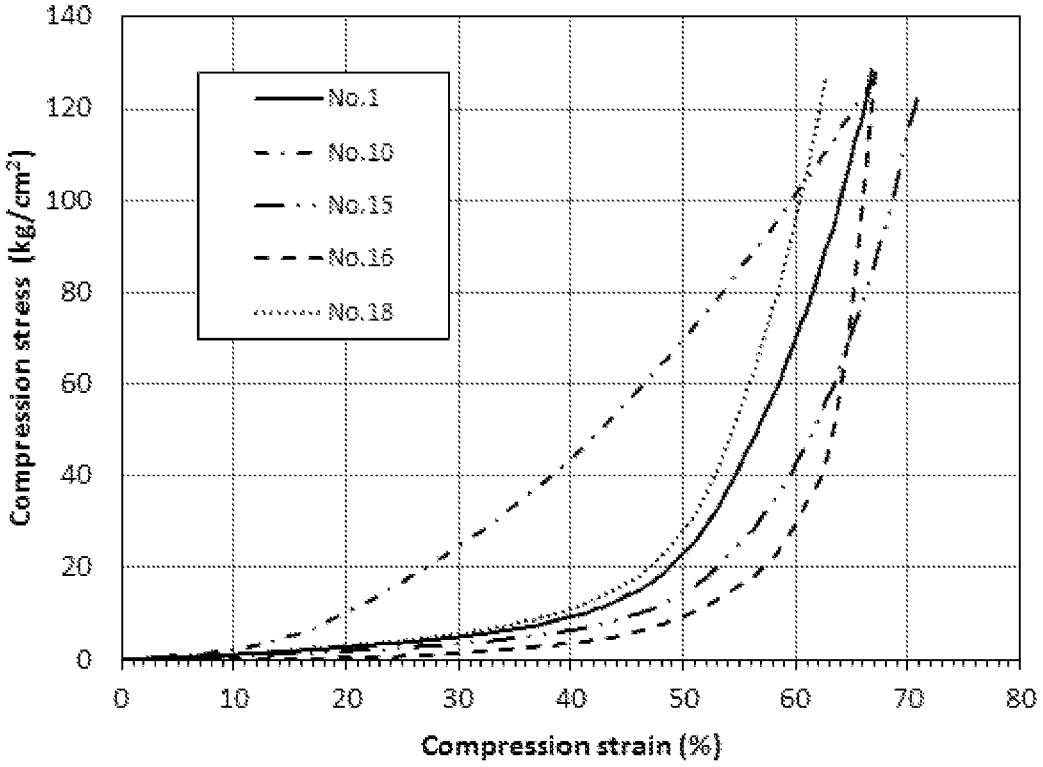
FIG. 5 is a graph showing a relationship between a compression stress and a compression strain of Grips No. 1, No. 10, No. 15, No. 16 and No. 18.

Foaming agent: "Expancel 909-80DU" (resin capsules encapsulating a hydrocarbon having a low boiling point in a shell formed from a thermoplastic resin, volume average diameter: 18 μm to 24 μm, expansion starting temperature: 120° C. to 130° C.) manufactured by Akzo Nobel Company The unvulcanized outer layer rubber sheet having a fan shape and the unvulcanized cap member were prepared using the rubber composition. The outer layer rubber sheet was formed with a fixed thickness. The unvulcanized inner layer rubber sheet having a rectangular shape was prepared using the rubber composition. The inner layer rubber sheet was formed with a thickness gradually becoming thicker from one end toward another end. The inner layer rubber sheet was wound around a mandrel, and then the outer layer rubber sheet was laminated and wound around thereon. The mandrel having these rubber sheets being wound therearound, and the cap member were charged into a mold having a groove pattern on the cavity surface thereof. Then, heat treatment was performed at the mold temperature of 160° C. for 15 minutes to obtain golf club grips. Evaluation results for each of the grips are shown in Table 2. In addition, the relationships between the compression stress and the compression strain of Grips No. 1, No. 3, No. 5, No. 7, No. 8, No. 10, No. 15, No. 16 and No. 18 are shown in FIG. 4 and FIG. 5.

TABLE 2

| Grip No. | | | 1 | 2 | 3 | 4 | 5 | 6 | 7 | 8 | 9 |
|---|---|---|---|---|---|---|---|---|---|---|---|
| Inner layer | Rubber composition No. | | B3 | B3 | B4 | B3 | C1 | B3 | A1 | B3 | C1 |
| | Material hardness (JIS-A) | | 52 | 52 | 53 | 52 | 58 | 52 | 45 | 52 | 58 |
| | Foaming agent (phr) | | 12.0 | 12.0 | 16.0 | 12.0 | 12.0 | 12.0 | 12.0 | 12.0 | 12.0 |
| | Density (g/cm$^3$) | | 0.33 | 0.33 | 0.25 | 0.33 | 0.34 | 0.33 | 0.32 | 0.33 | 0.34 |
| Outer layer | Rubber composition No. | | B | B | B | B1 | B | A | B | C | C |
| | Material hardness (JIS-A) | | 51 | 51 | 51 | 51 | 51 | 44 | 51 | 57 | 57 |
| | Foaming agent (phr) | | — | — | — | 2.0 | — | — | — | — | — |
| | Thickness (mm) | | 0.7 | 1.2 | 0.7 | 0.7 | 0.7 | 0.7 | 0.7 | 0.7 | 0.7 |
| | Density (g/cm$^3$) | | 1.00 | 1.00 | 1.00 | 0.80 | 1.00 | 0.97 | 1.00 | 1.04 | 1.04 |
| Grip properties | Mass (g) | | 22 | 25 | 19 | 20 | 22 | 22 | 22 | 22 | 23 |
| | Stress 20 kg/cm$^2$ | Displacement (mm) | 1.70 | 1.66 | 1.86 | 1.74 | 1.63 | 1.75 | 1.80 | 1.67 | 1.62 |
| | | Strain (%) | 48.6 | 47.4 | 53.1 | 49.7 | 46.6 | 50.0 | 51.4 | 47.7 | 46.3 |
| | Stress 120 kg/cm$^2$ | Displacement (mm) | 2.31 | 2.30 | 2.33 | 2.33 | 2.29 | 2.35 | 2.40 | 2.24 | 2.21 |
| | | Strain (%) | 66.0 | 65.7 | 66.6 | 66.6 | 65.4 | 67.1 | 68.6 | 64.0 | 63.1 |
| Evaluation | Feeling at waggling | | G | G | G | G | G | G | G | G | G |
| | Feeling at hitting | | G | G | G | G | G | G | F | G | F |
| | Overall evaluation | | G | G | G | G | G | G | G | G | G |

TABLE 3

| | Grip No. | | 10 | 11 | 12 | 13 | 14 | 15 | 16 | 17 | 18 | 19 |
|---|---|---|---|---|---|---|---|---|---|---|---|---|
| Inner layer | Rubber composition No. | | B | B2 | B2 | B3 | B3 | B3 | B5 | B3 | B3 | D1 |
| | Material hardness (JIS-A) | | 51 | 51 | 51 | 52 | 52 | 52 | 54 | 52 | 52 | 68 |
| | Foaming agent (phr) | | — | 6.0 | 6.0 | 12.0 | 12.0 | 12.0 | 20.0 | 12.0 | 12.0 | 12.0 |
| | Density (g/cm$^3$) | | 1.0 | 0.5 | 0.5 | 0.33 | 0.33 | 0.33 | 0.17 | 0.33 | 0.33 | 0.37 |
| Outer layer | Rubber composition No. | | — | B | B1 | B | B | — | B | B2 | D | B |
| | Material hardness (JIS-A) | | — | 51 | 51 | 51 | 51 | — | 51 | 51 | 67 | 51 |
| | Foaming agent (phr) | | — | — | 2.0 | — | — | — | — | 6.0 | — | — |
| | Thickness (mm) | | — | 0.7 | 0.7 | 2.1 | 0.3 | — | 0.7 | 0.7 | 0.7 | 0.7 |
| | Density (g/cm$^3$) | | — | 1.00 | 0.80 | 1.00 | 1.00 | — | 1.00 | 0.50 | 1.04 | 1.00 |
| Grip properties | Mass (g) | | 37 | 29 | 27 | 31 | 19 | 15 | 18 | 20 | 23 | 23 |
| | Stress 20 kg/cm$^2$ | Displacement (mm) | 0.95 | 1.45 | 1.56 | 1.09 | 1.80 | 1.85 | 2.00 | 1.76 | 1.64 | 1.58 |
| | | Strain (%) | 27.1 | 41.4 | 44.6 | 31.1 | 51.4 | 52.9 | 57.1 | 50.3 | 46.9 | 45.1 |
| | Stress 120 kg/cm$^2$ | Displacement (mm) | 2.28 | 2.28 | 2.30 | 2.28 | 2.44 | 2.47 | 2.34 | 2.45 | 2.17 | 2.23 |
| | | Strain (%) | 65.1 | 65.1 | 65.7 | 65.1 | 69.7 | 70.6 | 66.9 | 70.0 | 62.0 | 63.7 |
| Evaluation | Feeling at waggling | | P | F | F | P | G | G | P | G | G | P |
| | Feeling at hitting | | G | G | G | G | P | P | G | P | P | G |
| | Overall evaluation | | P | P | F | P | F | F | F | F | P | P |

Grips No. 1 to No. 9 comprise a cylindrical portion having a compression strain ($\epsilon 20$) in a range from 46% to 55% at a compression stress of 20 kg/cm$^2$, and a compression strain ($\epsilon 120$) in a range from 63% to 69% at a compression stress of 120 kg/cm$^2$. Any one of Grips No. 1 to No. 9 shows a good feeling both at hitting and at waggling, and is also excellent in overall evaluation.

Grips No. 10 to No. 13 and No. 19 are the cases having $\epsilon 20$ lower than 46%. Since the deformation amount thereof at waggling is small, they show an excessively hard feeling. Grips No. 14, No. 15 and No. 17 are the cases having $\epsilon 120$ higher than 69%. Since the deformation amount thereof at hitting is excessively large, they show a feeling of being unable to hold firmly. Grip No. 16 is the case having $\epsilon 20$ higher than 55%. Since the deformation amount thereof at waggling is excessively large, they show an excessively soft feeling. Grip No. 18 is the case having $\epsilon 120$ lower than 63%. Since the deformation amount thereof at hitting is small, they show an excessively hard feeling.

This application is based on Japanese patent application No. 2014-231357 filed on Nov. 14, 2014, the content of which is hereby incorporated by reference.

The invention claimed is:

1. A golf club grip comprising a cylindrical portion for inserting a shaft, wherein the cylindrical portion has a compression strain in a range from 46% to 55% at a compression stress of 20 kg/cm$^2$, and a compression strain in a range from 63% to 69% at a compression stress of 120 kg/cm$^2$, the cylindrical portion comprises a cylindrical inner layer and a cylindrical outer layer covering the cylindrical inner layer along the entire longitudinal direction thereof, the cylindrical inner layer material hardness $H_{in}$ (JIS-A) is higher than the cylindrical outer layer material hardness $H_{out}$ (JIS-A), and the cylindrical inner layer has a material hardness $H_{in}$ (JIS-A) in a range from 40 to 65, and the cylindrical outer layer has a material hardness $H_{out}$ (JIS-A) in a range from 40 to 65.

2. The golf club grip according to claim 1, wherein the cylindrical inner layer is a porous layer.

3. The golf club grip according to claim 1, wherein the cylindrical inner layer has a density in a range of 0.25 g/cm$^3$ to 0.40 g/cm$^3$.

4. The golf club grip according to claim 1, wherein the cylindrical outer layer has a thickness in a range of 0.5 mm to 1.5 mm.

5. The golf club grip according to claim 1, wherein a hardness difference ($H_{in}$–$H_{out}$) between the material hardness $H_{in}$ (JIS-A) of the cylindrical inner layer and the material hardness $H_{out}$ (JIS-A) of the cylindrical outer layer is more than 0 and 25 or less.

6. A golf club comprising a shaft, a head provided on one end of the shaft, and a grip provided on another end of the shaft, wherein the grip is a golf club grip comprising a cylindrical portion for inserting the shaft, the cylindrical portion has a compression strain in a range from 46% to 55% at a compression stress of 20 kg/cm$^2$, and a compression strain in a range from 63% to 69% at a compression stress of 120 kg/cm$^2$, the cylindrical portion comprises a cylindrical inner layer and a cylindrical outer layer covering the cylindrical inner layer along the entire longitudinal direction thereof, the cylindrical inner layer material hardness $H_{in}$ (JIS-A) is higher than the cylindrical outer layer material hardness $H_{out}$ (JIS-A), and the cylindrical inner layer has a material hardness $H_{in}$ (JIS-A) in a range from 40 to 65, and the cylindrical outer layer has a material hardness $H_{out}$ (JIS-A) in a range from 40 to 65.

7. The golf club according to claim 6, wherein the cylindrical inner layer is a porous layer.

8. The golf club grip according to claim 6, wherein the cylindrical inner layer has a density in a range of 0.25 g/cm$^3$ to 0.40 g/cm$^3$.

9. The golf club grip according to claim 6, wherein the cylindrical outer layer has a thickness in a range of 0.5 mm to 1.5 mm.

10. The golf club grip according to claim 6, wherein a hardness difference ($H_{in}$–$H_{out}$) between the material hardness $H_{in}$ (JIS-A) of the cylindrical inner layer and the material hardness $H_{out}$ (JIS-A) of the cylindrical outer layer is more than 0 and 25 or less.

* * * * *